US006205959B1

(12) United States Patent
Smetan et al.

(10) Patent No.: US 6,205,959 B1
(45) Date of Patent: Mar. 27, 2001

(54) MOTOR BLOCK AS WELL AS CASTING MOLD AND CASTING METHOD FOR THE MANUFACTURE THEREOF

(75) Inventors: Herbert Smetan; Klaus Lellig, both of Rehlingen (DE)

(73) Assignee: VAW alucast GmbH, Dillingen (DE)

( * ) Notice: Subject to any disclaimer, the term of this patent is extended or adjusted under 35 U.S.C. 154(b) by 0 days.

(21) Appl. No.: 09/358,143

(22) Filed: Jul. 20, 1999

(30) Foreign Application Priority Data

Jul. 21, 1998 (DE) ..... 198 32 718
Jun. 2, 1999 (DE) ..... 199 25 512

(51) Int. Cl.[7] ..... F02B 75/18
(52) U.S. Cl. ..... 123/41.74; 123/41.72
(58) Field of Search ..... 123/41.74, 41.72; 29/888.01, 888.072

(56) References Cited

U.S. PATENT DOCUMENTS 4,446,906 * 5/1984 Ackerman et al. ..... 164/112
4,586,553 5/1986 Allen et al. .
5,217,059 6/1993 Kuhn et al. .

FOREIGN PATENT DOCUMENTS 3300924 7/1984 (DE) .
3828093 3/1989 (DE) .
0197365 10/1986 (EP) .
2102317 2/1983 (GB) .

* cited by examiner

*Primary Examiner*—Henry C. Yuen
*Assistant Examiner*—Katrina B. Harris
(74) *Attorney, Agent, or Firm*—Friedrich Kueffner

(57) ABSTRACT

In an engine block having cylinder cavities arranged close together, a cooling duct is produced in an intermediate wall between the cylinders by pouring the casting material around a mold core made preferably from a material that is soluble in a liquid, combustible and/or brittle, so that the mold core can easily be removed from the duct once the casting has solidified. In the casting mold, the duct mold core is secured solely at its ends so that a cooling duct is formed that is bordered exclusively by a skin of casting material.

9 Claims, 5 Drawing Sheets

MOTOR BLOCK AS WELL AS CASTING MOLD AND CASTING METHOD FOR THE MANUFACTURE THEREOF

BACKGROUND OF THE INVENTION

1. Field of the Invention

The invention relates to an engine block having at least one cooling duct extending in an intermediate wall between the cylinders, said wall having a minimum casting material thickness of less than 5 mm, also a casting mold for the manufacture of such an engine block, and a method for manufacturing such an engine block.

2. Description of the Related Art

In order to keep the length of an engine block, e.g. a cast aluminum block, as short as possible, efforts are made to arrange the cylinder cavities of a row of cylinders closely adjacent to one another. As a result, the intermediate walls between the cylinders are correspondingly thin. Because of the more closely adjacent combustion chambers and the reduced heat conduction, these thin intermediate walls are exposed to increased thermal stress, especially at the end of the cylinder face closest to the cylinder head. Consequently, it is necessary to provide a cooling duct in the intermediate wall.

It is known in the art that a cooling duct can be produced by machining, namely by cutting into the engine block from the cylinder head seating surface of the block and then sealing the opening shut. This leaves behind a cooling duct that connects sections of a cooling jacket enclosing the row of cylinders, said sections of the cooling jacket extending on opposite sides of the row of cylinders. Alternatively, the engine block is drilled into from the side in order to produce such a cooling duct, and afterwards the drilled passage between the cooling jacket and the outer surface of the engine block must be sealed shut again.

SUMMARY OF THE INVENTION

It is the purpose of the present invention to create an engine block of improved quality while reducing the effort involved in its manufacture.

This task is performed by an engine block according to the invention, characterized in that the cooling duct is bordered solely by a skin of casting material, i.e. the engine block according to the invention is produced in a casting mold in which, for the purpose of producing the cooling duct, a duct mold core, secured only at its ends, is arranged between the mold cores for the cylinder cavities.

In an engine block according to the invention, the strength and durability are increased in comparison with a known engine block of similar type by virtue of the fact that the cooling duct is formed without any machining, i.e. without intervening in the solidification structure of the cast material.

In a preferred embodiment of the invention, the cross sectional area of the cooling duct is reduced from its ends towards a transverse axis of the cooling duct that perpendicularly intersects the axes of the cylinders. This reduction in cross sectional area takes account of the fact that the wall between the cylinders is reduced in thickness as this transverse axis is approached. As the thickness of the intermediate wall increases on both sides, so the cross sectional area of the cooling duct also increases, thereby advantageously reducing the flow resistance of the duct and increasing the throughflow of coolant.

The minimum width of the cooling duct in the direction of the transverse duct axis perpendicularly intersecting the axes of the cylinders may range between 0.5 and 1.5 mm.

While it is conceivable for the cross sectional area to have any desired form, the cross sectional area of the duct is preferably elongate, with a longitudinal axis running parallel to the cylinder axes. While the width of the cooling duct is limited by the thickness of the wall between the cylinders, in the direction of the cylinder axes the cooling duct can widen to a relatively large extent, thus increasing the throughflow cross section.

In a preferred embodiment of the invention, the cooling duct extends in a straight line between oppositely arranged sections of a cooling jacket enclosing the row of cylinders.

The casting mold core is made of a material that is soluble in a liquid, or combustible, and/or brittle, namely in particular a salt, carbon and/or glass.

Once the casting material has been poured and has solidified, a salt core can be removed from the casting by dissolving it out. It is obvious that a soluble salt must be chosen that has a melting temperature above the temperature of the casting material used. A carbon core can be burnt out, for which purpose it may be necessary to supply oxygen to promote the combustion process. It is further conceivable that a pyrotechnical core material may be used, said material comprising carbon and an oxidizing agent added to the carbon, such that the composition of the material ensures full removal of the core by combustion while, however, avoiding explosive combustion.

A brittle glass core may be removed from a narrow cooling duct, even if the entrances to the cooling duct are not accessible to tools, by using, for example, ultrasonic means to shatter the core into small pieces. The glass core may be appropriately prepared for this process by being prestressed. Alternatively, the glass core may be removed by a pressurized water jet.

In a further preferred embodiment of the invention, the casting mold core is attached at its ends to a part of the casting mold possessing the cores for forming the cylinders. This measure ensures that the cooling duct is arranged in the prescribed position within the intermediate wall, with little deviation in tolerance, relative to the cores forming the cylinder cavities and thus relative to the cylinder cavities themselves. If the cooling duct mold were attached to another part of the casting mold, larger manufacturing tolerances would have to be accepted with respect to the positioning of the cooling duct due to fluctuations in the exactness of the fit of the casting mold parts relative to each other.

The invention will now be explained and described in more detail on the basis of embodiments and the attached drawings referring to these embodiments.

DESCRIPTION OF THE PREFERRED EMBODIMENTS

Figure 1:
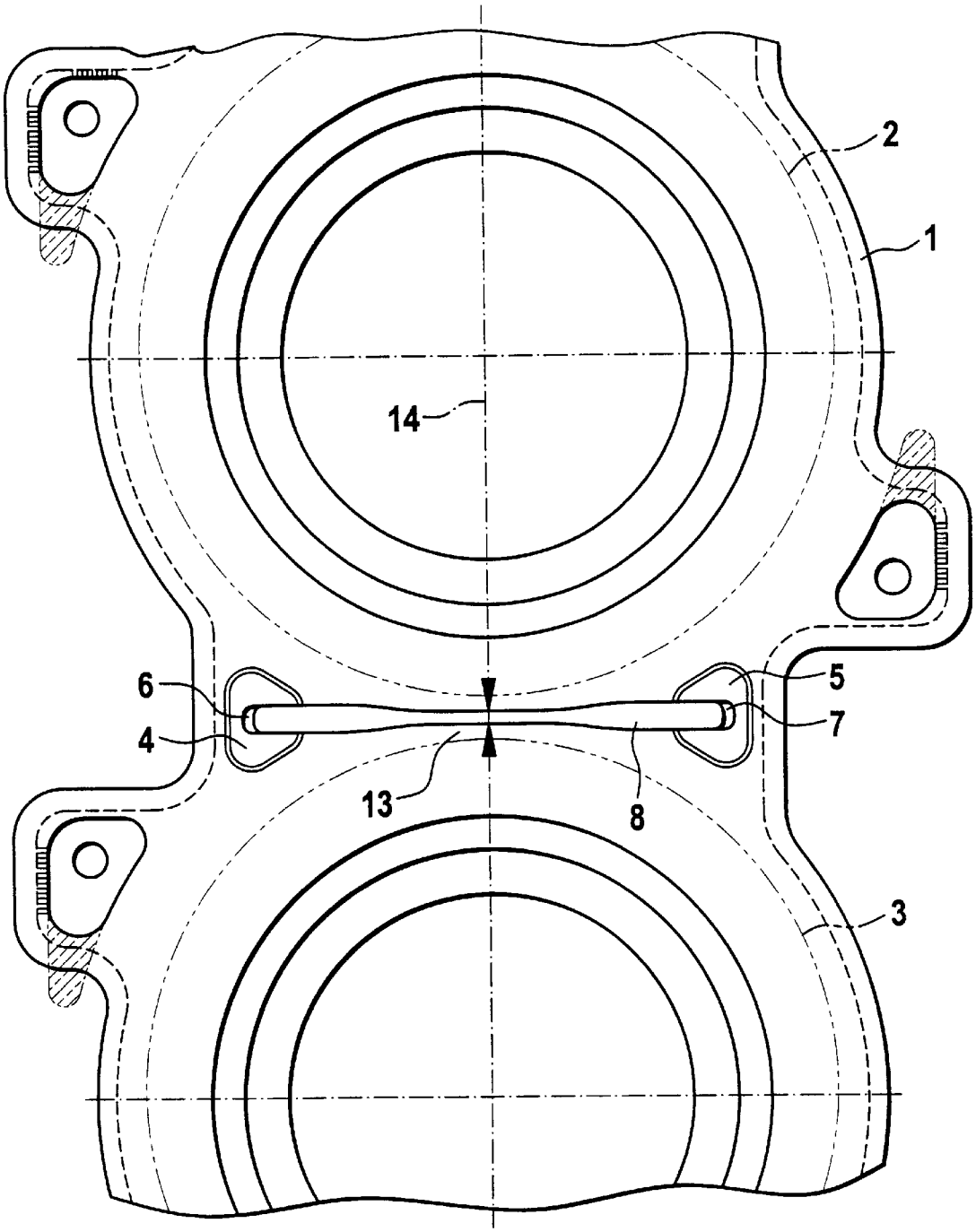
FIG. 1 depicts a top view of part of a casting mold according to the invention.
Figure 2:
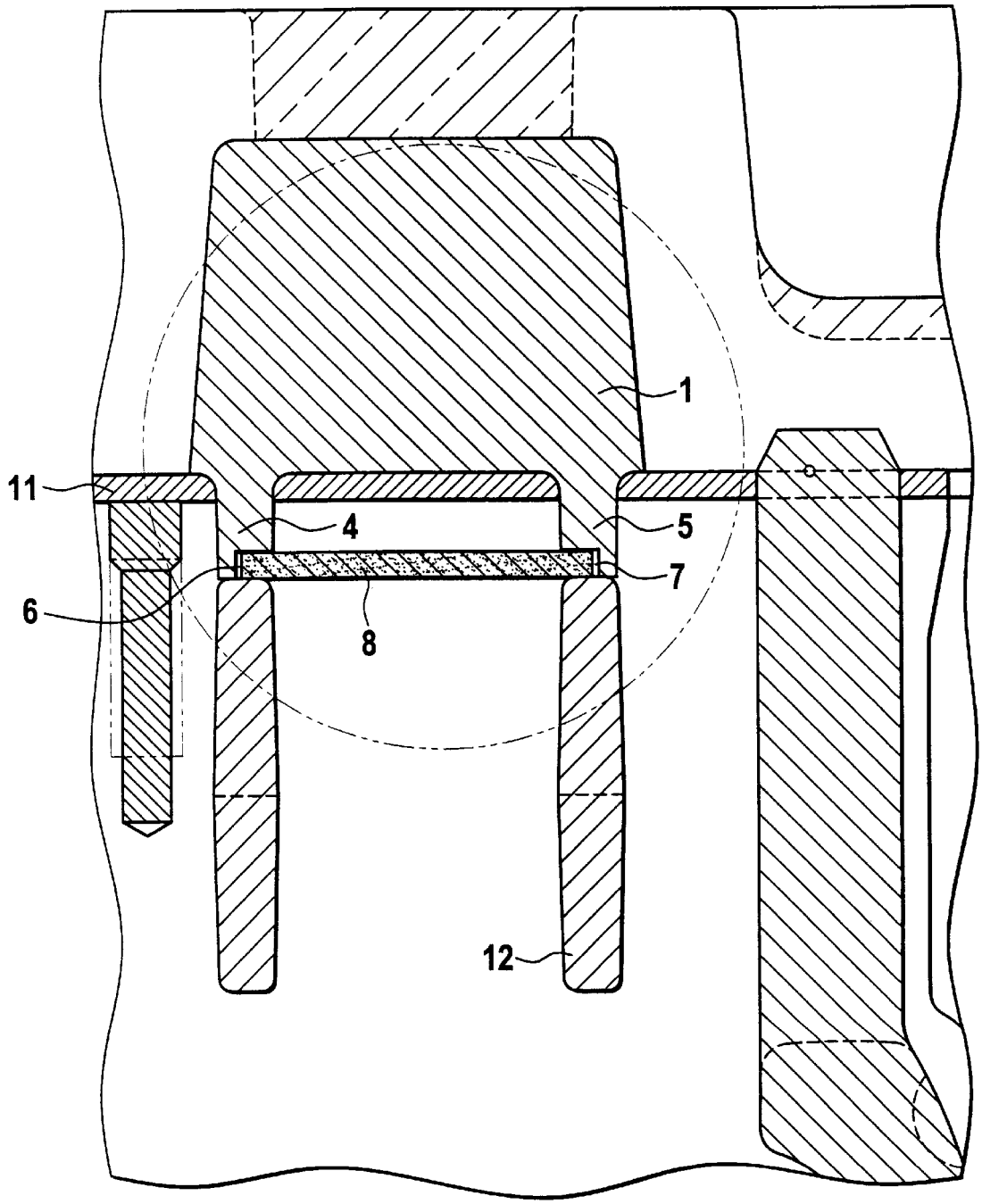
FIG. 2 is a cross sectional view through the said casting mold and contains the casting mold part shown in FIG. 1

In FIGS. 1 and 2 the reference number 1 denotes a casting mold part having cores 2 and 3 for forming cylinder cavities.

In addition, the casting mold part 1 possesses lugs 4 and 5 provided with a groove 6 or 7 respectively. The ends of a salt core 8 are inserted into the grooves 6 and 7. Each of the grooves 6, 7 is long enough to give the salt core 8 room to expand in each groove.

As can be seen from FIG. 2, the lugs form an opening in the top part 11 of the engine block facing the cylinder head. While securing the salt core 8 in the grooves 6, 7 the lugs 4,5 abut against a further casting mold part 12, by means of which a cooling jacket surrounding the cylinders is formed.

At 13 an intermediate wall of casting material is formed between the cylinder cavities; the minimum width of this wall is indicated by the arrows in the drawing.

As is apparent from FIG. 1, the initially constant width of the salt core 8 decreases from each end towards a transverse axis 14 perpendicularly intersecting the cylinder axes, and at this axis attains a width of 1 mm, while the outer sections of the salt core in this embodiment are 2.5 mm wide. The minimum thickness of the intermediate wall formed from the casting material at 13, including the minimum duct width, is 2.5 mm. Grey cast iron bushings still to be cast into the engine block, thus making the overall web width 5.5 mm, are not shown here. The salt core 8 is rectangular in cross section, with the long rectangular side of the cross section extending perpendicular to the cylinder axes and having a dimension of 4 mm in the embodiment depicted.

The salt core 8 is manufactured from NaCl that has a melting point higher than the temperature of the liquid aluminum casting material used to manufacture the engine block. Depending on the casting material, other salts and salt mixtures may be used.

In the embodiment depicted, the salt core 8 is manufactured by pressing and subsequent sintering.

Following a casting and solidification process, hot water is used to dissolve the salt core out of the casting and a cooling duct is formed linking the sections of the cooling jacket on both sides of the row of cylinders, said cooling duct being bordered solely by a continuous skin of casting material, thereby imparting a high degree of strength to the thin wall between the cylinders. The cooling duct ensures adequate heat removal and thus high thermal resistance of the engine produced from the engine block.

During the casting process, the salt core expands, and the length of the grooves 6,7 offers sufficient space for this expansion to occur.

Deviating from the embodiment shown, the salt core could be broader at its ends than is depicted here, thus enhancing the cooling effect.

Mounting the salt core on the lugs 4,5, which are elements of casting mold part 1 holding the cores 2,3, ensures that the cooling duct is arranged in the intermediate wall at 13 in the desired position relative to the cylinder axes, with minimal deviations in tolerance. If, instead, the core 8 were to be mounted on casting mold part 12 forming the cooling jacket, the position of the cooling duct would be subject to large fluctuations.

When the core 8 is dissolved out of the formed casting, the dissolution process can be accelerated by using hot and possibly pressurized water.

Figure 3:
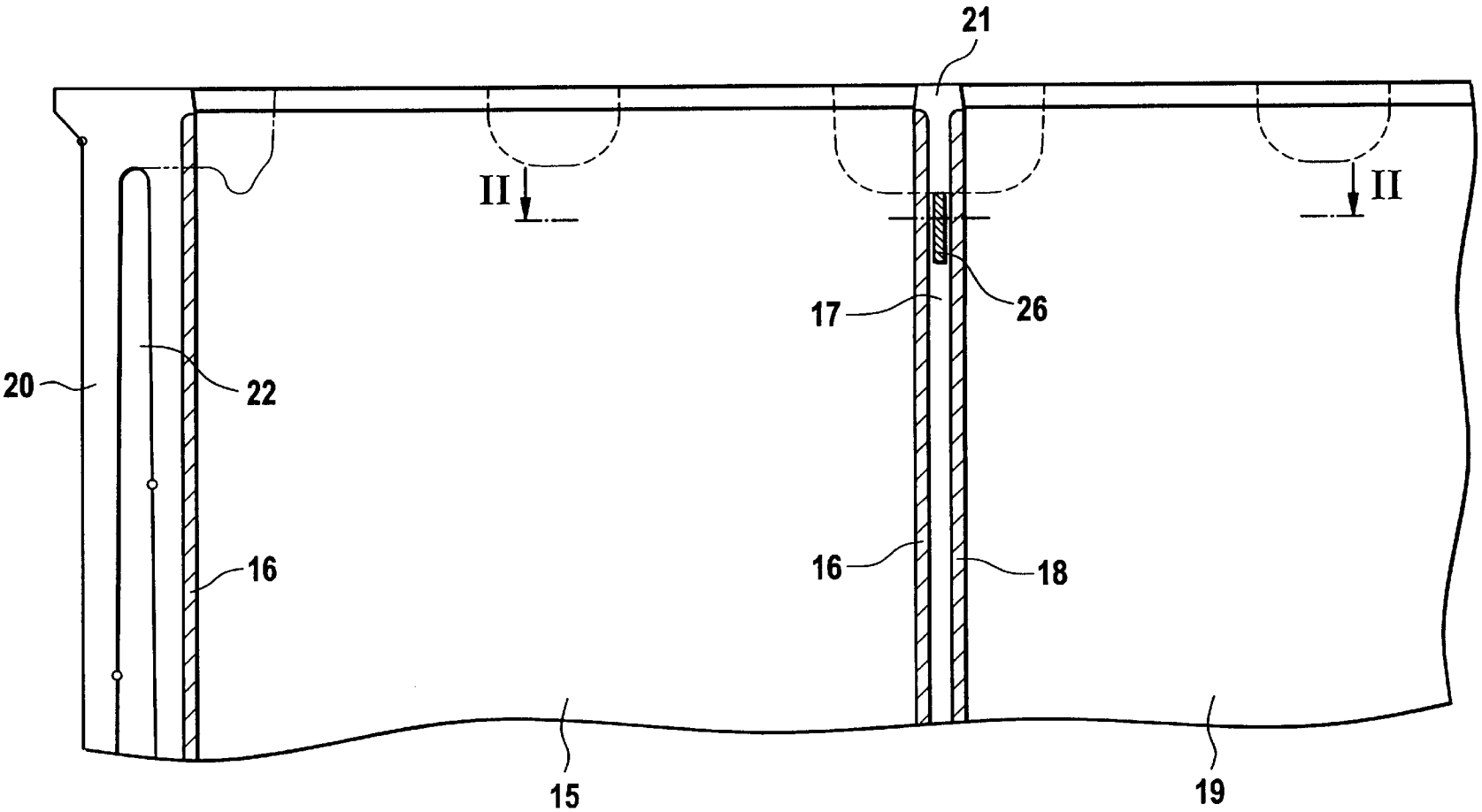
FIG. 3 is a cut-away side elevation of the engine block according to the invention.
Figure 4:
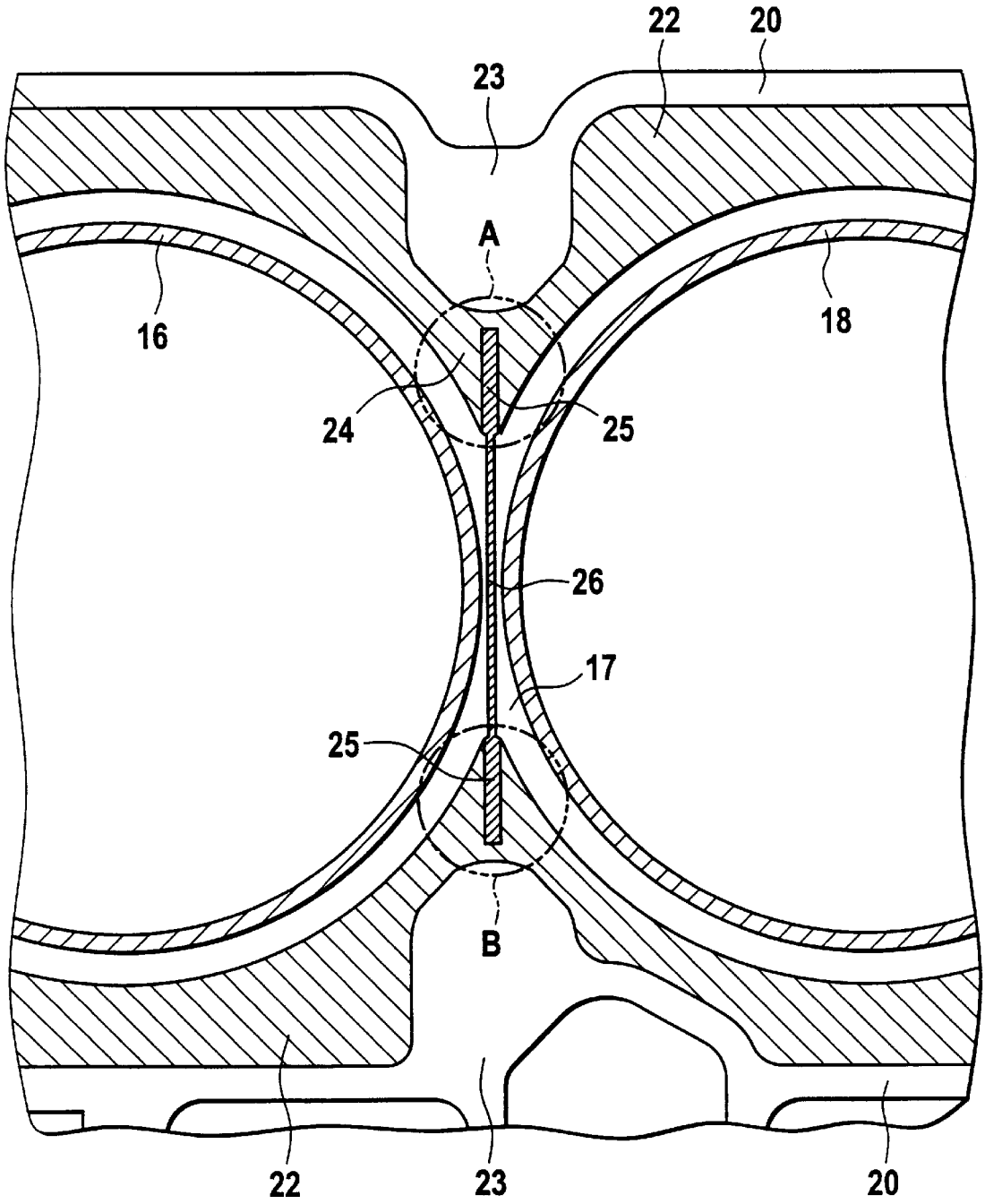
FIG. 4 is a cross-sectional view of the engine block depicted in FIG. 3.

Reference is now made to FIGS. 3 and 4.

FIG. 3 shows a first cylinder cavity 15 of an engine block having a lining 16, a first intermediate wall 17 between the cylinders, and a lining 18 of a next cylinder cavity 19.

FIG. 4 contains half views of the cylinder cavities 15, 19, with the intermediate wall 17 between them. The circled sections A and B additionally depict the status of the casting mold.

Also visible in the FIGS. are an outer wall 20 of the engine block, a cylinder head surface 21, a water jacket 22, and two stud bolts 23 for attaching a cylinder head.

In the encircled areas A and B is depicted the mold core 24 forming the water jacket 22. In this mold core is incorporated a graphite plate 26 having two thickened end sections 25. Between these thickened end sections 25 the graphite plate is approximately 1.2 mm thick and approximately 12 mm high. It extends, with these dimensions, centrally through the thickness of the intermediate wall 17 at a height immediately below the stud bolts 23.

Outside the encircled areas A and B in FIGS. 3 and 4 the graphite plate 26 is shown still in place in the cast engine block after the latter has been removed from the mold.

The graphite plate 26 is then removed by burning it out. The graphite plate is ignited while blowing oxygen over it, and it burns up completely if oxygen is continuously blown into the duct opened up by the burning process. To accelerate the process, the oxygen may be introduced from both ends. In a variant of this embodiment, an oxidizing agent may be added to the graphite material so that the burning can take place without the need for any such supporting measures.

The water circulates in the engine block with a slight difference in pressure between one side of the row of cylinders and the other side. As a result, it flows through the duct formed by the graphite plate 26, thereby enabling the removal of heat.

The procedure may be used equally advantageously to produce other thin passageways conducting water, oil or gas in a cylinder block or cylinder head, and it is particularly suitable also for producing narrow water ducts between the valve bores in a cylinder head.

Figure 5:
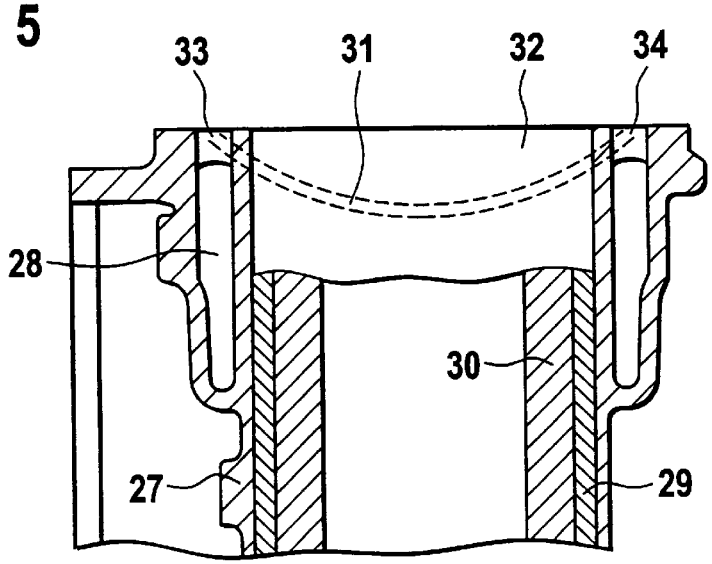
FIG. 5 depicts a further embodiment of an engine block according to the invention having a curved cooling duct shown in cross-sectional view.
Figure 6:
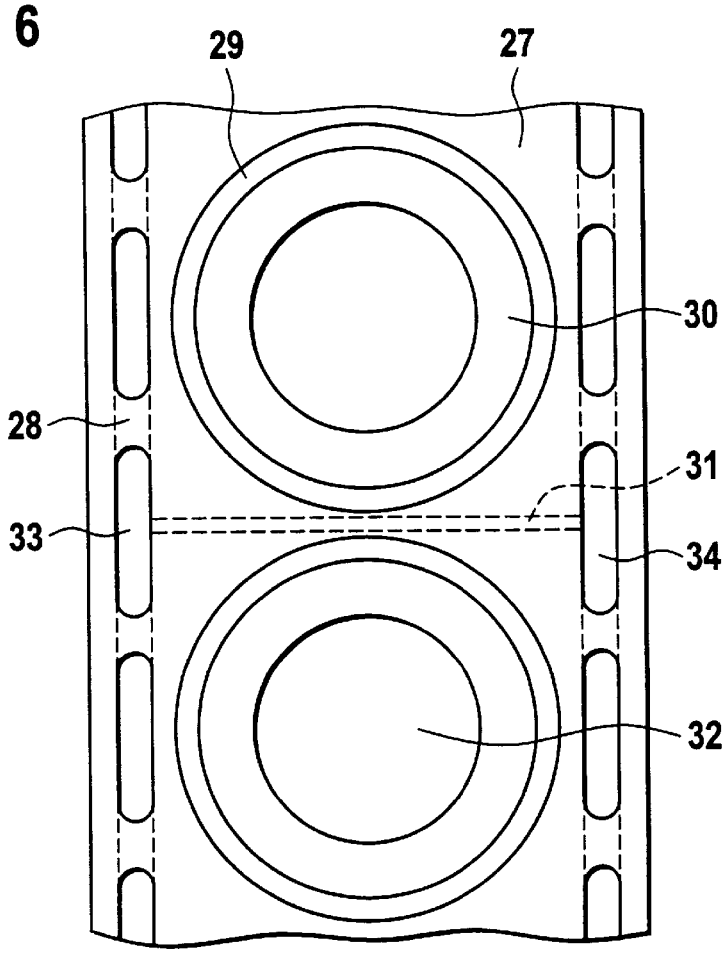
FIG. 6 is a top view of the engine block depicted in FIG. 5.

Reference is now made to FIGS. 5 and 6. In the said Figs., the reference number 27 denotes a cast engine block. The engine block 27, depicted in cross section by means of broad hatching, is produced from an aluminum alloy. Reference number 28 denotes a casting mold part used to form a cooling jacket enclosing the cylinders of the engine block 27. Cylinder liners 29 are integrated into the engine block 27 by pouring the casting material around them. The cylinder liners 29 sit in the casting mold with their entire inner surface in contact with a hollow cylindrical chill mould element 30. The casting mold, which is not further depicted here, is a sand mold.

In FIGS. 5 and 6, the reference number 31 denotes a glass core extending between neighbouring cylinder cavities 32 of the engine block 27, from one part 33 of the sand casting mold to another part 34 of the sand casting mold. The parts 33, 34 of the sand casting mold are linked with the part 28 of the sand casting mold, said part forming the cooling jacket, and their purpose is to form openings in the cooling jacket at the seating surface of the cylinder head on the engine block 1.

The arcuately configured glass core is embedded at either end in casting mold parts 33 and 34 respectively.

In the embodiment depicted here, the glass material has a thermal expansion coefficient of slightly less than $10^{-6}K^{-1}$. The glass transition temperature is 700° C. The glass core 31 has a diameter of 1 mm.

As shown in FIGS. 5 and 6, a core is arranged between each of the cylinder cavities 32 of the engine block 27.

During the casting process, the glass core 31 is surrounded by casting material, the glass being able to withstand the temperature stress associated with being thus embedded. Soon after it is surrounded by the casting material, the glass core reaches the same temperature as this material and thus at the same time attains its maximum thermal expansion during the casting process. The glass core then cools down in thermal equilibrium together with the casting material. Because of its higher coefficient of thermal expansion, the latter material shrinks to a greater extent than the glass core 31. This shrinkage regularly causes the glass core 31 to shatter. To encourage this, the glass core may be suitably pretreated by quenching, abrasive blasting, etching and/or scoring, in particular in such a way that a large number of easily removable fragments is formed.

In the embodiment depicted, the glass core 31 is arcuately laid, such that a flexible pushing tool can be inserted through the openings formed at the seating surface of the cylinder head to remove the glass core from the mold in the event that it does not break, or only partially breaks, when the shrinkage occurs.

The arcuate glass core in the depicted embodiment could also be straight. In that case, ultrasonic treatment or high-pressure jet treatment of the casting could be considered as a means of removing the glass core from the casting.

In the manner described above, it is possible to produce ducts having very smooth inner walls, similar to the quality of bores, without having to intervene in the structure of the casting. Advantageously, no deposits from the coolant can attach themselves to the walls of these ducts. It would not be possible, without damaging the engine block, to produce such cooling ducts by drilling between the cylinder cavities in the engine block.

It is advantageous to pretreat the glass core in the manner described above so that it is given a structure, in particular a stressed structure, that will enable the glass to fracture more easily when shrinkage occurs or when it is subsequently broken out of the block.

In addition to the examples shown, which relate to an engine block having a cooling duct between the cylinders, salt cores, graphite cores or glass cores may also be used in other parts of the engine block, for example to produce ducts through which coolant or oil may be supplied to certain functional elements in the engine.

What is claimed is:

1. An engine block comprising cylinders, an intermediate wall between the cylinders and at least one cooling duct extending in the intermediate wall, the intermediate wall having a minimum casting material thickness of less than 5 mm, the cylinders having cylinder axes and the cooling duct having a cross-sectional axis perpendicularly intersecting the cylinder axes, wherein the cooling duct is bordered exclusively by a skin of casting material, and wherein the cooling duct has a minimum width in a direction of the cross-sectional axis of between 0.5 mm and 1.0 mm.

2. The engine block according to claim 1, wherein a cross-sectional area of the cooling duct is reduced from ends thereof towards the cross-sectional axis.

3. The engine block according to claim 2, wherein the cross-sectional area of the duct is elongate and the duct has a longitudinal axis, wherein the longitudinal axis extends parallel to the cylinder axes.

4. The engine block according to claim 1, wherein the cylinders are arranged in a row, and wherein the cooling duct extends rectilinearly between opposite sections of a cooling jacket surrounding the row of cylinders.

5. A casting mold for producing an engine block comprising a cooling duct extending between cylinder cavities of a row of cylinders, a wall of casting material having a minimum thickness of less than 5 mm being located between the cylinder cavities, and a duct mold core of glass secured only at ends thereof being arranged in the casting mold between cores forming the cylinder cavities.

6. The casting mold according to claim 5, wherein the duct mold core is secured at the ends thereof to a casting mold part having the cores for forming the cylinder cavities.

7. The casting mold according to claim 5, comprising attachment points for the duct mold core, wherein spaces are provided at the attachment points for permitting longitudinal extension of the duct mold core during casting.

8. A method of manufacturing an engine block having at least one cooling duct located in an intermediate wall between adjacent cylinder cavities, wherein the wall formed by casting material has a thickness of less than 5 mm, the method comprising arranging a duct mold core of glass in casting mold between cores forming the cylinder cavities, and attaching the duct mold core only at ends thereof.

9. The method according to claim 8, comprising securing the duct mold core at the ends thereof on a part of the casting mold having the cores for forming the cylinder cavities.

* * * * *